US009528670B2

(12) United States Patent
Wu

(10) Patent No.: US 9,528,670 B2
(45) Date of Patent: Dec. 27, 2016

(54) ELECTRONIC LIGHTING DEVICE SIMULATING REAL FIRE

(71) Applicant: Shangqiang Wu, Guangdong (CN)

(72) Inventor: Shangqiang Wu, Guangdong (CN)

( * ) Notice: Subject to any disclaimer, the term of this patent is extended or adjusted under 35 U.S.C. 154(b) by 84 days.

(21) Appl. No.: 14/430,912

(22) PCT Filed: Jul. 24, 2014

(86) PCT No.: PCT/CN2014/082909
§ 371 (c)(1),
(2) Date: Mar. 24, 2015

(87) PCT Pub. No.: WO2015/139399
PCT Pub. Date: Sep. 24, 2015

(65) Prior Publication Data

US 2016/0146413 A1 May 26, 2016

(30) Foreign Application Priority Data

Apr. 10, 2014 (CN) ..... 2014 1 0141739

(51) Int. Cl.

| | |
|---|---|
| ***F21S 10/04*** | (2006.01) |
| ***F21S 6/00*** | (2006.01) |
| ***F21V 14/08*** | (2006.01) |
| *F21W 121/00* | (2006.01) |
| *F21Y 101/02* | (2006.01) |

(52) U.S. Cl.
CPC ..... *F21S 10/046* (2013.01); *F21S 6/001* (2013.01); *F21V 14/08* (2013.01); *F21W 2121/00* (2013.01); *F21Y 2101/02* (2013.01)

(58) Field of Classification Search
CPC ..... F21S 10/046; F21S 6/001; F21V 14/08
See application file for complete search history.

(56) References Cited

U.S. PATENT DOCUMENTS

| | | | | |
|---|---|---|---|---|
| 2011/0019422 | A1* | 1/2011 | Schnuckle | F21S 10/04 362/277 |
| 2012/0134157 | A1* | 5/2012 | Li | F21S 10/04 362/277 |

(Continued)

FOREIGN PATENT DOCUMENTS

| | | | |
|---|---|---|---|
| CN | 203115826 | U | 8/2013 |
| CN | 203431703 | U | 2/2014 |
| CN | 203757583 | U | 8/2014 |

*Primary Examiner* — David V Bruce
(74) *Attorney, Agent, or Firm* — Prakash Nama; Global IP Services, PLLC

(57) ABSTRACT

An electronic lighting device simulating real fire comprising a flame sheet (1), a supporting frame (2), a light emitting element (3) and a drive mechanism; the flame sheet (1) comprises a flame section (1.1), a balance section (1.2) and a supporting point (1.3); the supporting point (1.3) is positioned between the flame section (1.1) and the balance section (1.2); the drive mechanism is positioned corresponding to a middle part of the flame sheet (1); the drive mechanism exerts driving force to the middle part of the flame sheet (1). The electronic lighting device simulating real fire has a compact design. When the flame sheet swings, the ferromagnet is always positioned within the strong magnetic field of the electromagnetic coil. Therefore, the magnetic force can be much better utilized and thus a weaker current should be sufficient to drive the flame sheet to swing reciprocally.

7 Claims, 13 Drawing Sheets

(56) References Cited

U.S. PATENT DOCUMENTS

| | | | | |
|---|---|---|---|---|
| 2013/0050985 | A1* | 2/2013 | Kwok | F21S 10/046 362/96 |
| 2016/0053954 | A1* | 2/2016 | Lai | F21S 10/046 362/393 |

* cited by examiner

ELECTRONIC LIGHTING DEVICE SIMULATING REAL FIRE

BACKGROUND OF THE INVENTION

The present invention relates to a kind of electronic lighting device simulating real fire.

In daily life, various kinds of electronic lighting devices which serve simulating functions are widely used by various ornamentation and toys. These electronic lighting devices are much safer than traditional real fire and they can be controllably adjusted on demand. These electronic lighting devices create joyful user's experience. However, existing electronic lighting devices simulating candle flame are heavy, structurally complicated and contain too many internal structural components, thereby increasing processing costs such as manufacturing and installation costs. Chinese granted patent CN101865413B, published on 20 Oct. 2010, discloses an "electronic lighting device for simulating real fire and method for simulating real fire by the electronic lighting device", according to which "the electronic lighting device for simulating real fire comprises a core; the core comprises an enclosure, a light-emitting element, a flame sheet and a swing mechanism; the enclosure is provided with a through hole on a top thereof; the flame sheet is movably supported or suspended on the enclosure, wherein the flame sheet comprises an upper sheet which is of a flame-like shape, and the upper sheet is configured to expose above the top of the enclosure through the through hole of the enclosure; the light-emitting element is installed on a sidewall of the enclosure such that an outgoing direction of a light from the light-emitting element is inclined upward and passing through the through hole of the enclosure, wherein the outgoing direction is intersected with a surface of the upper sheet, so that the light from the light-emitting element is projected on the surface of the upper sheet; the swing mechanism is disposed beneath the flame sheet, wherein the swing mechanism is configured to apply a force on the flame sheet when powered to actuate the flame sheet to sway or swing". The Chinese patent has disclosed a relatively complicated structure and the use of relatively large number of components; specifically, the structuring of a swing mechanism disposed beneath the flame sheet requires relatively large space, thereby not being compact enough and thus resulting in higher manufacturing costs. The U.S. granted patent U.S. Pat. No. 8,070,319B2, published on 6 Dec. 2011, discloses a "kinetic flame device"; Claim 1 of this U.S. patent discloses "an apparatus for simulating a flame, comprising: a housing including an interior space; a drive mechanism generating a time varying electromagnetic field that extends into the interior space; a pendulum member pivotally mounted within the interior space of the housing, the pendulum member including a magnet or ferrous tag on a first end positioned proximate to the drive mechanism, whereby the magnet or ferrous tag interacts with the time varying electromagnetic field, wherein the pendulum member further includes a flame silhouette element extending from a second end of the pendulum member; and a light source adapted to selectively transmit light onto the flame silhouette element". The pendulum member described in this U.S. patent is equivalent to the flame sheet described in the mentioned Chinese patent; the magnet or ferrous tag is on a first end of the pendulum member, and the flame silhouette element is on another end; in other words, the drive mechanism is disposed at either of the two ends of the pendulum member. Therefore, as same as the mentioned Chinese patent, this U.S. patent is likewise not simple and compact enough in terms of its space for structuring. Besides, the U.S. patent configures the drive mechanism below the pendulum member and the magnet right above the electromagnetic coil, but this configuration requires repulsive force between the magnetic pole of magnetic field created by the electromagnetic coil and the magnetic pole of the magnet in order to swing the flame sheet (pendulum member); therefore, pole direction of the magnet must be checked before installation and this in turn burdens the workload during mass industrial production and increases manufacturing costs. Further, in this U.S. patent, the magnet or ferrous tag is at an end of the pendulum member and the drive mechanism is proximate to this end; if the drive mechanism is disposed below the pendulum member, it will achieve the effect described by the U.S. patent; if the drive mechanism is disposed at one side of the bottom portion of the pendulum member, the drive mechanism may not be able to act on the pendulum member if it is placed too far away from the pendulum member, but the drive mechanism may instead hinder the swinging movement of the pendulum member if it is placed too close to the pendulum member since an end portion of the pendulum member must swing more dramatically than a middle portion of the pendulum.

BRIEF SUMMARY OF THE INVENTION

In view of the aforesaid disadvantages now present in the prior art, the present invention provides a structurally simple and compact electronic lighting device simulating real fire which helps reduce manufacturing costs. The inventor has discovered that the balanced condition of the pendulum member can be easily disturbed at the supporting point. A slight amount of external force exerted to the supporting point can cause the pendulum member to lose its balance and therefore swing. Therefore, the pendulum member can swing well regardless of whether attractive force or repulsive force is created between the magnetic pole of the magnetic field of the electromagnetic coil and the magnetic pole of the ferromagnet. Hence, it is not necessary to check the pole direction of the ferromagnet, thereby shortening the manufacturing process and thus facilitating production. Furthermore, when a pendulum member according to the existing prior art swings, the ferromagnet cannot be always positioned within a strong magnetic field of the electromagnetic coil and thus cannot satisfactorily utilize the magnetic force. As such, the electromagnetic coil requires stronger current to drive the pendulum member to swing reciprocally. On the contrary, the present invention positions the drive mechanism corresponding to the middle part of the pendulum member, so that when the flame sheet swings, the ferromagnet is always positioned within the strong magnetic field of the electromagnetic coil. Therefore, the magnetic force can be much better utilized and thus a weaker current should be sufficient to drive the flame sheet to swing reciprocally.

According to the present invention, the electronic lighting device simulating real fire comprises a flame sheet, a supporting frame, a light emitting element and a drive mechanism; the flame sheet mainly comprises a flame section, a balance section and a supporting point; the supporting point is positioned between the flame section and the balance section; the drive mechanism is positioned corresponding to a middle part of the flame sheet; the drive mechanism exerts driving force to the middle part of the flame sheet.

The drive mechanism comprises an electromagnetic coil and a permanent magnet/magnetic medium; the permanent magnet/magnetic medium is mounted on the middle part of the flame sheet; the electromagnetic coil and a circuit board are provided on the supporting frame; the electromagnetic coil is also positioned corresponding to the middle part of the flame sheet to exert the driving force to the permanent magnet/magnetic medium on the flame sheet.

The flame sheet passes through a central hole enclosed by the electromagnetic coil, and the middle part of the flame sheet is surrounded by the electromagnetic coil.

The electromagnetic coil is positioned at an outer side of the middle part of the flame sheet.

According to a preferred embodiment of the present invention, a ferromagnet being the permanent magnet/magnetic medium is mounted on the middle part of the flame sheet; magnetic poles of the ferromagnet are vertically oriented and the electromagnetic coil is positioned at the outer side of the middle part of the flame sheet; magnetic poles of magnetic field created by the electromagnetic coil are horizontally oriented; the ferromagnet is positioned within an area of the magnetic field of the electromagnetic coil having the strongest magnetic force.

A supporting rod is provided on the supporting frame; a small hole is provided on the flame sheet as the supporting point; part of the supporting rod is bended to form a V shaped structure; the flame sheet is supported on the V shaped structure of the supporting rod via the small hole.

A supporting rod is provided on the supporting frame; the supporting rod has a pin shape; the flame sheet is provided with a cap as the supporting point; the cap has a conical cavity; the supporting point with the conical cavity sleeves the supporting rod to support the flame sheet.

The permanent magnet/magnetic medium is positioned near to but above the supporting point or near to but below the supporting point.

The light emitting element is mounted on the circuit board or on the supporting frame.

The present invention also comprises an outer shell; an upper end of the outer shell is provided with a through hole for the flame sheet to swing; the outer shell sleeves the supporting frame from outside; only an upper part of the flame sheet passes through the through hole of the outer shell.

Working principle of the electromagnetic coil and the ferromagnet: the electromagnetic coil creates a magnetic field when powered; magnetic force of the magnetic field acts on the ferromagnet at the middle part of the flame sheet; specifically, the magnetic force being acted on the ferromagnet may be attractive force or repulsive force depending on the electrical current direction of the electromagnetic coil and how the magnetic poles of the ferromagnet are positioned. When the electromagnetic coil is not yet powered, the flame sheet is in a balanced condition on the supporting point. When the electromagnetic coil is powered, the magnetic force disturbs the balanced condition and causes the flame sheet to swing.

The present invention having the above described structure has the following advantages:

1. The present invention provides a structure for the assembly of the flame sheet and the drive mechanism that cooperates with the flame sheet. The present invention can cause the flame sheet to swing freely, but the present invention has modified the drive mechanism to be positioned corresponding to the middle part of the flame sheet to drive the flame sheet whereas in conventional structure the drive mechanism is positioned below or at the bottom end portion of the flame sheet. Accordingly, the present invention does not require additional installation space below or at the bottom of the flame sheet. By means of this reasonable structural design, the present invention fully utilizes the potential space existing along the length of the flame sheet.

2. The ferromagnet is surrounded by the electromagnetic coil or proximate to an outer side of the center of the electromagnetic coil, so the ferromagnet receives stronger magnetic force, thereby receiving better driving force from the electromagnetic coil. Since the present invention positions the drive mechanism corresponding to the middle part of the flame sheet, the ferromagnet is always positioned within the strong magnetic field of the electromagnetic coil when the flame sheet swings. Therefore, the magnetic force can be much better utilized and thus a weaker current should be sufficient to drive the flame sheet to swing reciprocally.

3. The balanced condition of the pendulum member can be easily disturbed at the supporting point. A slight amount of external force exerted to the supporting point can cause the pendulum member to lose its balance and therefore swing. Therefore, the pendulum member can swing well regardless of whether attractive force or repulsive force is created between the magnetic pole of the magnetic field of the electromagnetic coil and the magnetic pole of the ferromagnet. Hence, it is not necessary to check the pole direction of the ferromagnet, thereby facilitating production process.

DETAILED DESCRIPTION OF THE INVENTION

Figure 1:
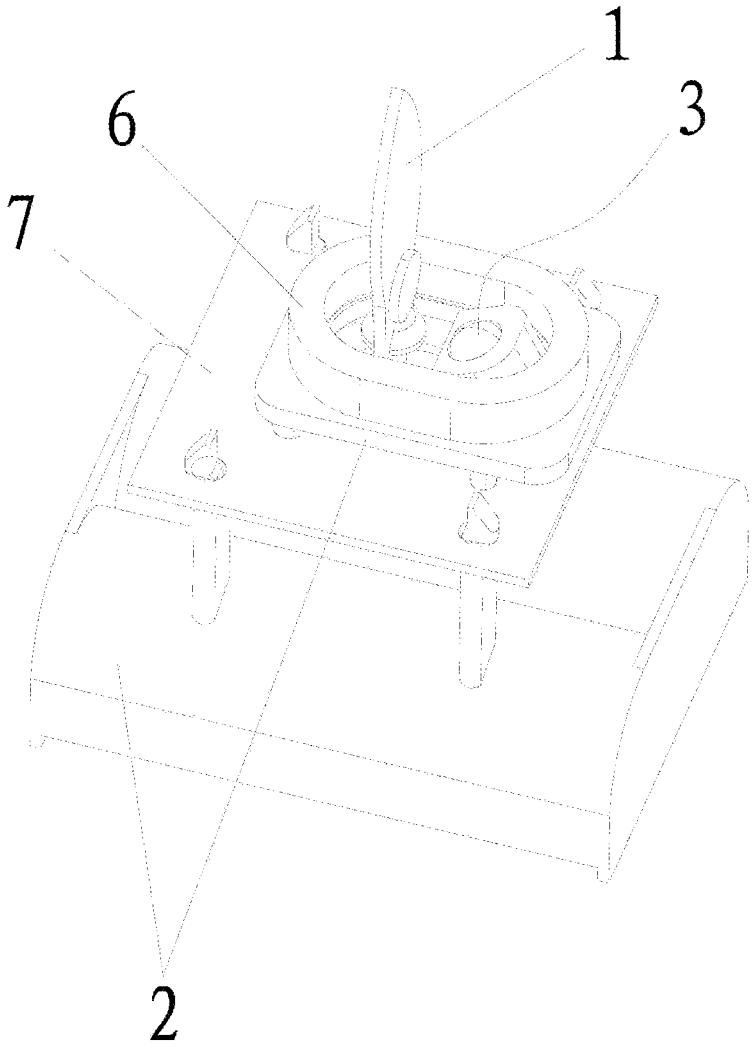
FIG. 1 is a schematic view of the electronic lighting device simulating real fire according to the present invention.

The present invention is further described in detail below with reference to embodiments and the accompanying drawings.

As shown in FIGS. 1-9, an electronic lighting device simulating real fire according to the present invention is mainly an assembly of the following components: a flame sheet 1, a supporting frame 2, a light emitting element 3 and a drive mechanism. Specifically, the supporting frame 2 serves a supporting function; each of other components has to rely on the supporting frame 2 in order to be installed, assembled or fixed. During use, a power supply is also mounted onto the supporting frame 2. The supporting frame 2 can have different specific shapes and structures based on specific needs. The light emitting element 3 can be any light bulb or LED light. The light emitting element 3 should emit light towards the flame sheet 1. The light emitting element 3 is connected with the power supply via a circuit board 7. If necessary, some other small components can be mounted on the circuit board 7.

The drive mechanism provides a driving force for the flame sheet 1 to swing. The flame sheet 1 comprises a several sections, namely a flame section 1.1, a balance section 1.2 and a supporting point 1.3. The flame section 1.1 cooperates with the light emitting element 3 to simulate real fire. The supporting point 1.3 is supported on the supporting frame 2 in order to install the flame sheet 1. The balance section 1.2 at a bottom part of the flame sheet 1 is provided for balancing and stabilizing. The supporting point 1.3 is positioned between the flame section 1.1 and the balance section 1.2.

In the present invention, the drive mechanism is positioned corresponding to a middle part of the flame sheet 1 in order to exert the driving force to the middle part of the flame sheet 1. Here, the phrase "middle part" should not be taken as an exactly accurate middle point of the flame sheet 1, instead, the "middle part" is an approximate location allowing slight deviation.

Figure 10:
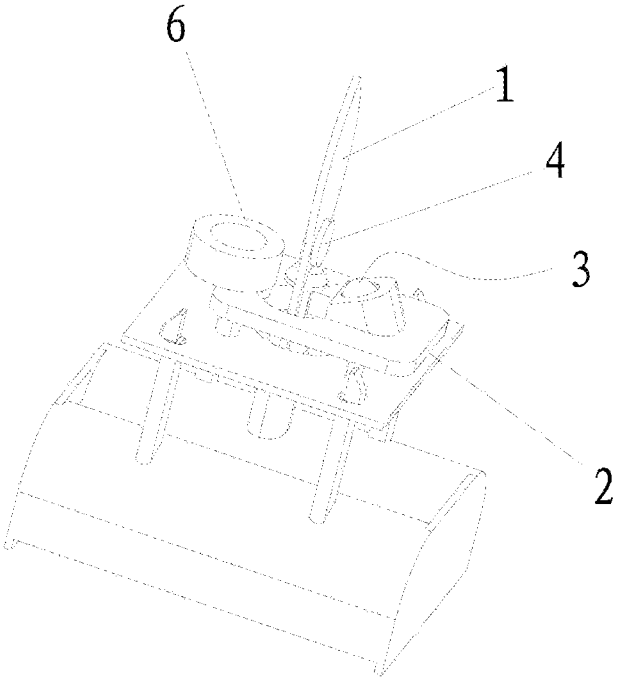
FIG. 10 is yet another structural view of the electronic lighting device simulating real fire according to the present invention.

In the present embodiment, the drive mechanism is electromagnetically driven. The driving force of the drive mechanism is realized by mutual interaction between an electromagnetic coil 6 and a permanent magnet/magnetic medium 4. For simplification, it is simpler and more cost saving to use a permanent magnet, i.e. a ferromagnet, as the permanent magnet/magnetic medium 4. The ferromagnet is mounted on the middle part of the flame sheet 1. The circuit board 7 is mounted on the supporting frame 2. The electromagnetic coil 6 is positioned corresponding to the middle part of the flame sheet 1 and is mounted on the circuit board 7 or the supporting frame 2 so as to exert the driving force to the permanent magnet/magnetic medium 4 mounted on the middle part of the flame sheet 1. For example, the flame sheet 1 passes through a central hole enclosed by the electromagnetic coil 6, and the middle part of the flame sheet 1 is surrounded by the electromagnetic coil 6. Another possibility is that the electromagnetic coil 6 is positioned at an outer side of the middle part of the flame sheet 1. In other words, the electromagnetic coil 6 can surround the flame sheet 1, or can just be positioned at one side of the flame sheet 1 as shown in FIG. 10. The electromagnetic coil 6 can be positioned corresponding to a central part of the ferromagnet, or it can be positioned corresponding to a suitable deviated position from the central part of the ferromagnet, and the suitable deviated position is defined in that it is a position where the ferromagnet can still be subject to the driving force from the electromagnetic coil 6 for swinging the flame sheet 1. It should be noted that, relative positioning between the ferromagnet and the electromagnetic coil 6 may change; the relative positioning may be realized above the supporting point 1.3 or below the supporting point 1.3. A specific relative positioning to be realized may be decided at the time of manufacturing based on practical needs.

Further, the flame sheet 1 can be supported via different methods. Two more practical methods will be described below:

The first method is shown in FIGS. 4-7: a supporting rod 5 is provided on the supporting frame 2; the supporting point 1.3 on the flame sheet 1 is formed as a small hole; part of the supporting rod 5 is bended to form a V shape section; the flame sheet 1 is supported on the V shape section of the supporting rod 5 via the small hole; a circular through hole is also opened on the circuit board 7 for the flame sheet 1 to pass through, and this configuration can also somehow prevent the flame sheet 1 from falling out; the circuit board 7 presses against the supporting frame 2; the electromagnetic coil 6 is positioned on the circuit board 7.

Figure 2:
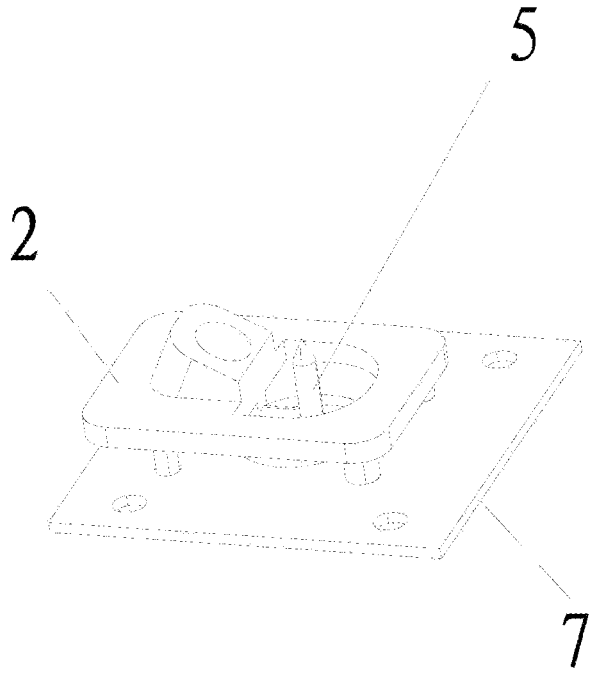
FIG. 2 is a partial view of the electronic lighting device simulating real fire according to the present invention.
Figure 3:
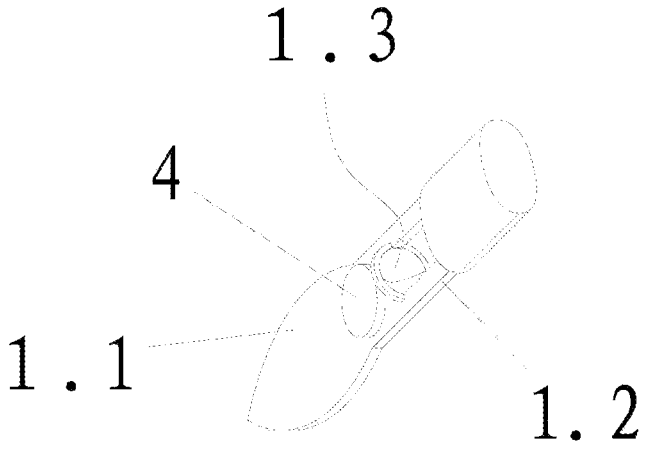
FIG. 3 shows a structure of the flame sheet of the electronic lighting device simulating real fire according to the present invention.
Figure 4:
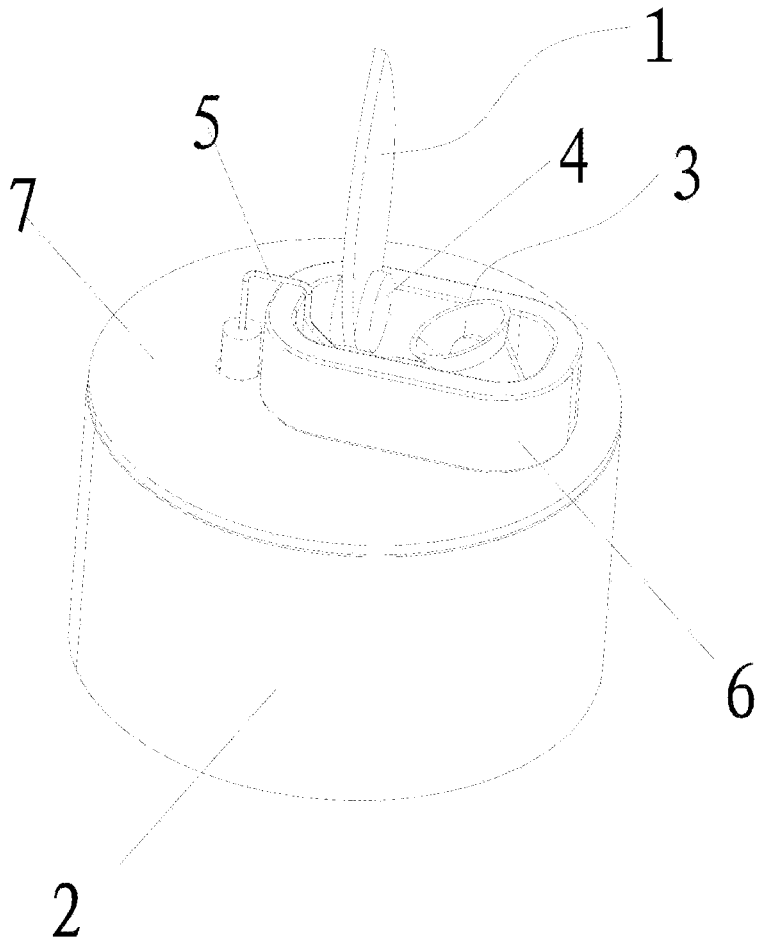
FIG. 4 is a structural view of the electronic lighting device simulating real fire according to another embodiment of the present invention.
Figure 5:
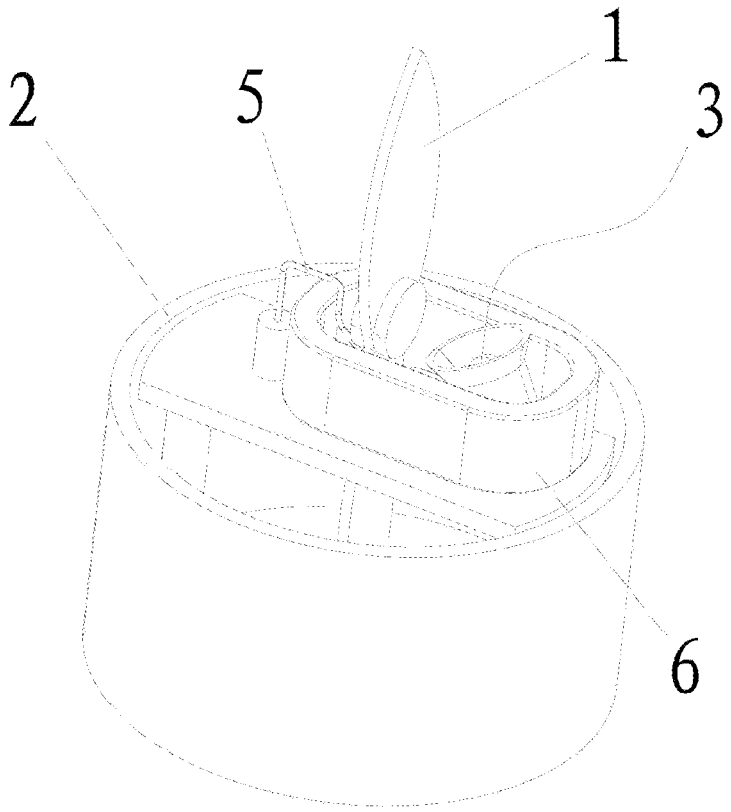
FIG. 5 is a partial structural view of the electronic lighting device simulating real fire according to another embodiment of the present invention.
Figure 6:
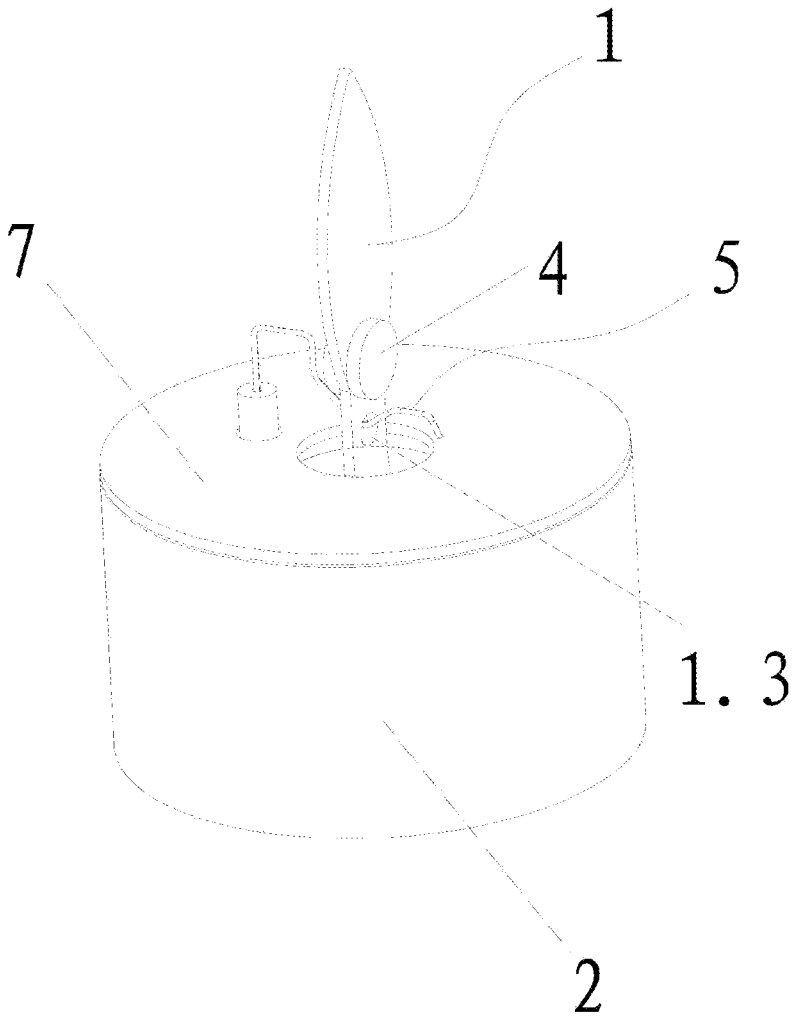
FIG. 6 is another partial structural view of the electronic lighting device simulating real fire according to another embodiment of the present invention.
Figure 7:
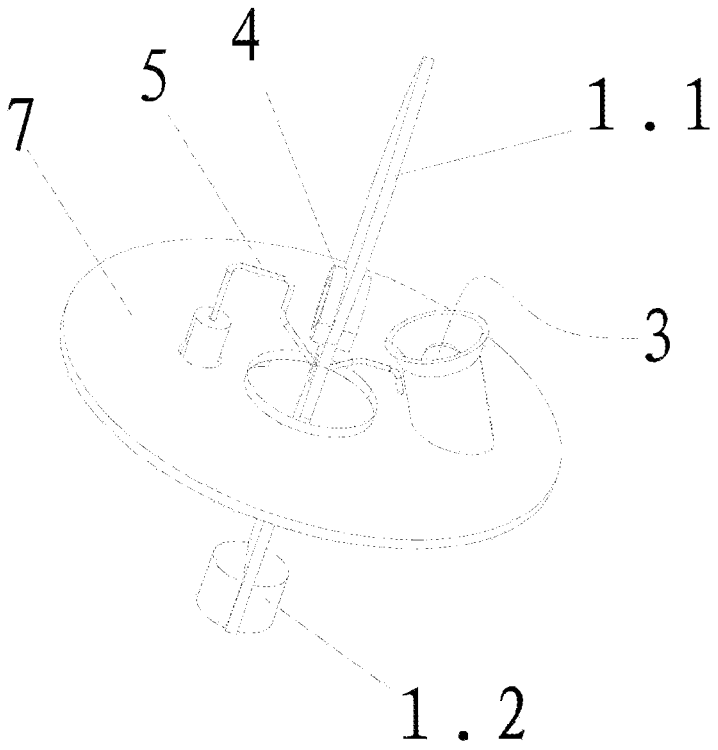
FIG. 7 shows an assembled structure of certain components of the electronic lighting device simulating real fire according to the present invention.

The second method is shown in FIGS. 1-3: a supporting rod 5 is provided on the supporting frame 2; the supporting rod 5 has a pin shape; the balance section 1.2 at the bottom part of the flame sheet 1 is a hollow frame providing ample space; an upper part of the hollow frame, in other words a lower end of the flame section 1.1, is provided with a cap as the supporting point 1.3; the cap has a conical cavity; the supporting point 1.3 with the conical cavity sleeves the supporting rod 5 to support the flame sheet 1; a circular through hole is also opened on the circuit board 7 for the flame sheet 1 to pass through, and this configuration can also somehow prevent the flame sheet 1 from falling out; in this second method, the supporting frame 2 a battery box and a supporting plate; the circuit board 7 is positioned above the battery box via a few supporting columns; the supporting plate is mounted on the circuit board 7, and the electromagnetic coil 6 is mounted on the supporting frame 2.

In the above two methods, the flame sheet 1 is supported in a manner that the flame sheet 1 can swing freely.

Subject to practical circumstances, the light emitting element 3 is mounted on the circuit board 7 or on the supporting frame 2 so that lights are emitted to the flame section 1.1 of the flame sheet 1.

Figure 8:
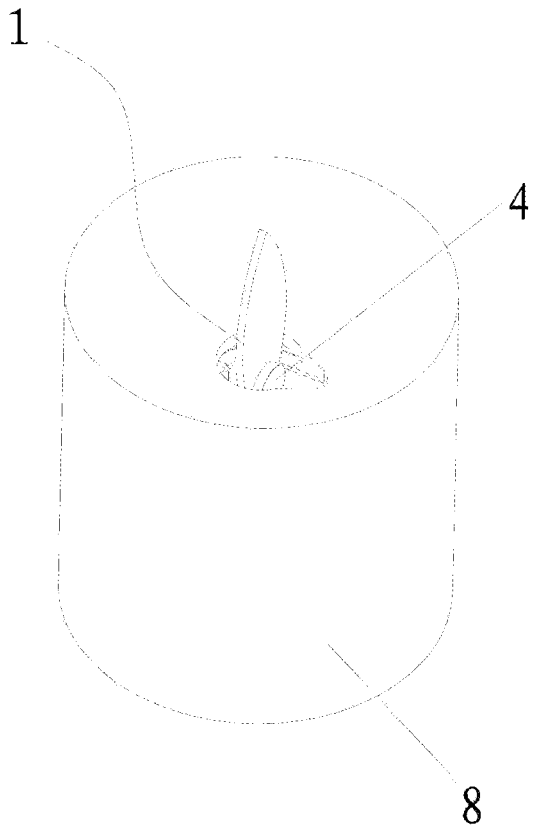
FIG. 8 is another structural view showing the state of use of the electronic lighting device simulating real fire according to the present invention.
Figure 9:
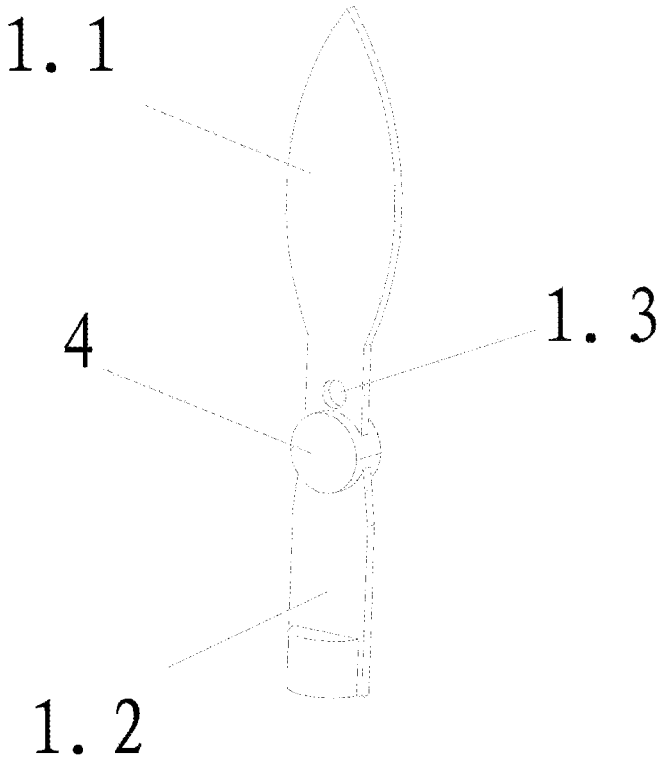
FIG. 9 shows a structure of another kind of flame sheet of the electronic lighting device simulating real fire according to the present invention.

As a modification, the present invention also comprises an outer shell 8 as shown in FIG. 8; all components mentioned above are all inside the outer shell 8, except that an upper end of the outer shell 8 is provided with a through hole for the flame section 1.1 at an upper part of the flame sheet 1 to pass through and swing; after the outer shell 8 has sleeved the supporting frame 2 from outside, only the upper part of the flame sheet 1 passes through the through hole of the outer shell 8; the outer shell 8 can block dispersed light; a more preferable effect can be achieved when the light bulb or LED light emits lights to the flame sheet 1 via the through hole of the outer shell 8; further, a modified configuration in which the drive mechanism is positioned corresponding to the middle part of the flame sheet 1 as described but without the electromagnetic coil surrounding the exact center of the flame sheet should also fall within the scope of protection of the present invention.

Figure 11:
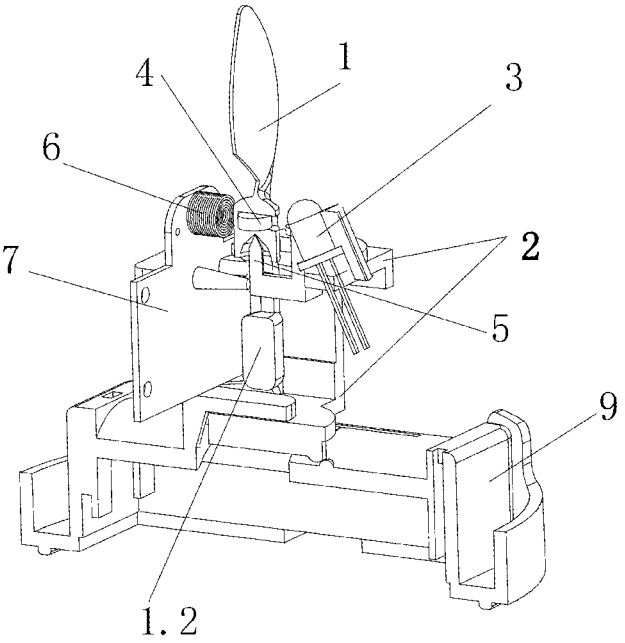
FIG. 11 shows a structure of the electronic lighting device simulating real fire according to a preferred embodiment of the present invention.

The most preferred embodiment of the present invention is described below:

As shown in FIG. 11, the electronic lighting device simulating real fire comprises the flame sheet 1, the supporting frame 2, the light emitting element 3 and the drive mechanism; the flame sheet 1 mainly comprises the flame section 1.1, the balance section 1.2 and the supporting point 1.3; the supporting point 1.3 is positioned between the flame section 1.1 and the balance section 1.2. The drive mechanism is positioned corresponding to the middle part of the flame sheet 1; the drive mechanism exerts driving force to the middle part of the flame sheet 1.

The drive mechanism is electromagnetically driven; the driving force of the drive mechanism is realized by mutual interaction between the electromagnetic coil 6 and the permanent magnet/magnetic medium 4; the permanent magnet/magnetic medium 4 is a ferromagnet; the ferromagnet is mounted on the middle part of the flame sheet 1; the circuit board 7 is mounted on the supporting frame 2; the electromagnetic coil 6 is mounted on the circuit board 7 and is positioned at the outer side of the middle part of the flame sheet 1; when powered, the electromagnetic coil 6 exerts the driving force to the ferromagnet on the flame sheet 1 to drive the flame sheet 1 to swing. In the present invention, the drive mechanism is positioned corresponding to the middle part of the flame sheet 1 in order to exert the driving force to the middle part of the flame sheet 1. Here, the phrase "middle part" should not be taken as an exactly accurate middle point of the flame sheet 1, instead, the "middle part" is an approximate location allowing slight deviation.

Magnetic poles of the magnetic field created by the electromagnetic coil 6 are horizontally oriented. Magnetic poles of the ferromagnet are vertically oriented. The ferromagnet is positioned within an area of the magnetic field of the electromagnetic coil 6 having the strongest magnetic force.

In the present invention, both the two methods of supporting the flame sheet 1 allow the flame sheet 1 to swing freely. As shown in FIG. 11, the supporting rod 5 is provided on the supporting frame 2; the supporting rod 5 has a pin shape; the balance section 1.2 at the bottom part of the flame sheet 1 is a hollow frame providing ample space; the upper part of the hollow frame, in other words a lower end of the flame section 1.1, is provided with a cap as the supporting point 1.3; the cap has a conical cavity; the supporting point 1.3 with the conical cavity sleeves the supporting rod 5 to support the flame sheet 1; the circuit board 7 is provided on the supporting frame 2; the supporting frame 2 is provided on a base 9; the battery box is also provided on the base 9; the light emitting element 3 is mounted on the supporting frame 2 and is connected with the battery box via the circuit board 7.

Figure 12:
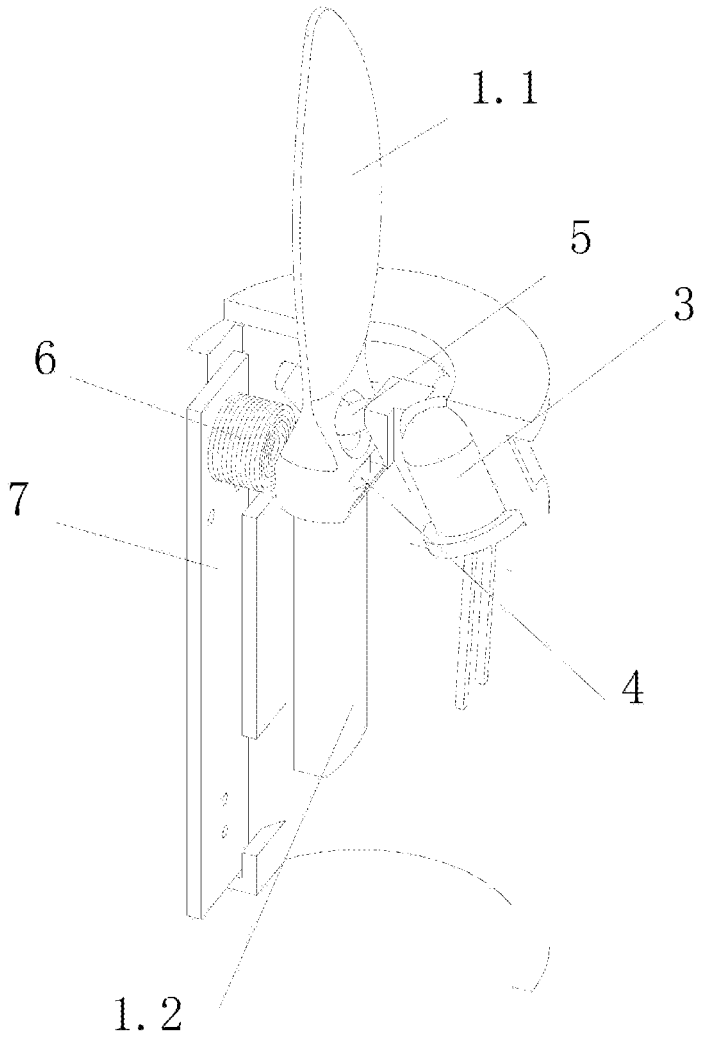
FIG. 12 is yet another structural view of the electronic lighting device simulating real fire according to the present invention.
Figure 13:
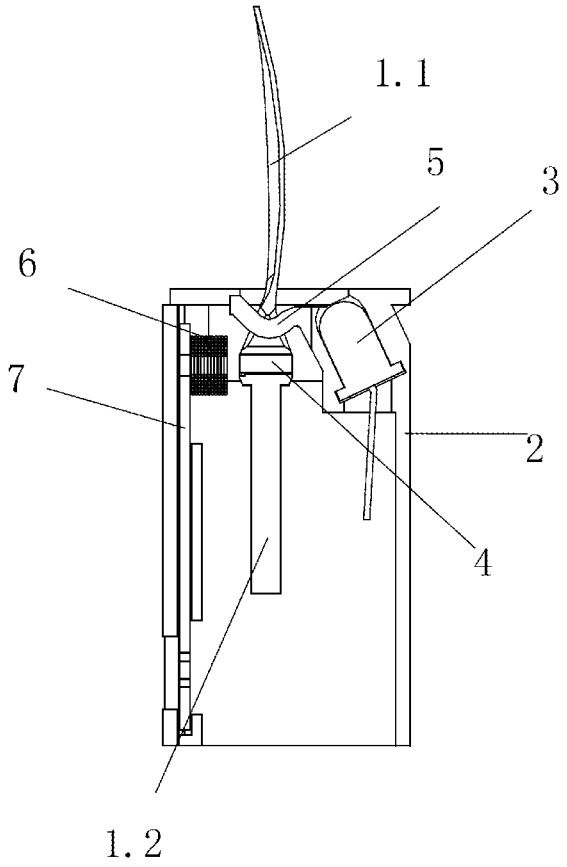
FIG. 13 is a structural view of the electronic lighting device in which the supporting rod has a V shape section.

Another method of supporting the flame sheet 1 is shown in FIGS. 12-13. The supporting rod 5 is provided on the supporting frame 2. Part of the supporting rod 5 is bended to form a V shape section. The supporting point 1.3 on the flame sheet 1 is formed as a small hole. The flame sheet 1 is supported on the V shape section of the supporting rod 5 via the small hole.

Figure 14:
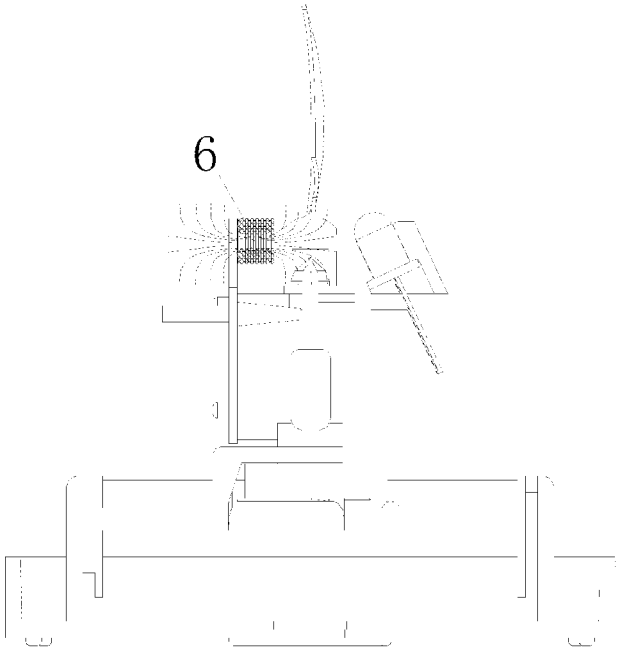
FIG. 14 shows a relative position between the ferromagnet and the magnetic induction lines when the flame sheet being a pendulum member of the electronic lighting device of the present invention is in a balanced condition.
Figure 15:
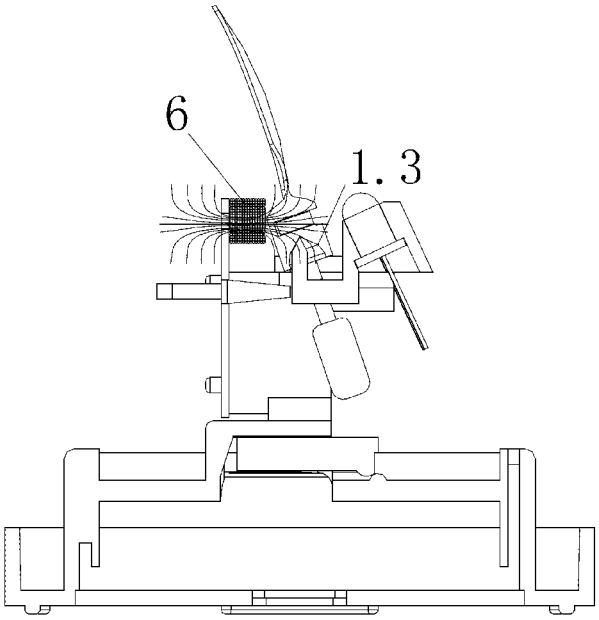
FIG. 15 shows a relative position between the ferromagnet and the magnetic induction lines when the flame sheet being a pendulum member of the electronic lighting device of the present invention swings.
Figure 16:
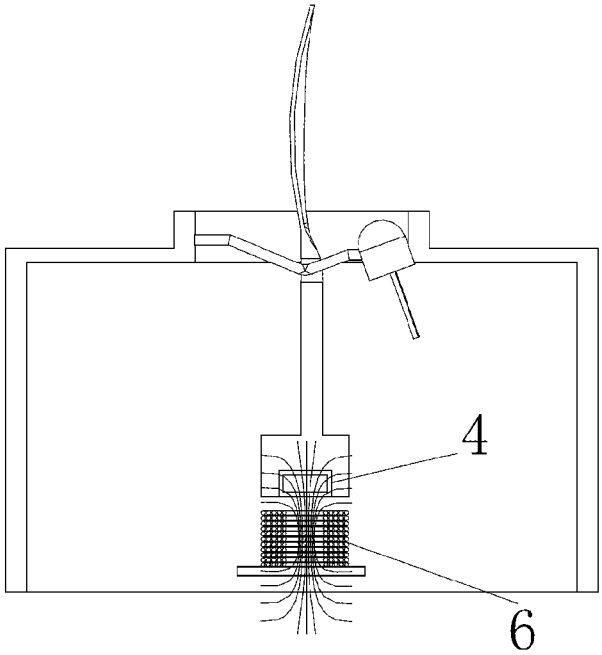
FIG. 16 shows a relative position between a ferromagnet and magnetic induction lines when a flame sheet being a pendulum member of an electronic lighting device of the existing prior art is in a balanced condition.
Figure 17:
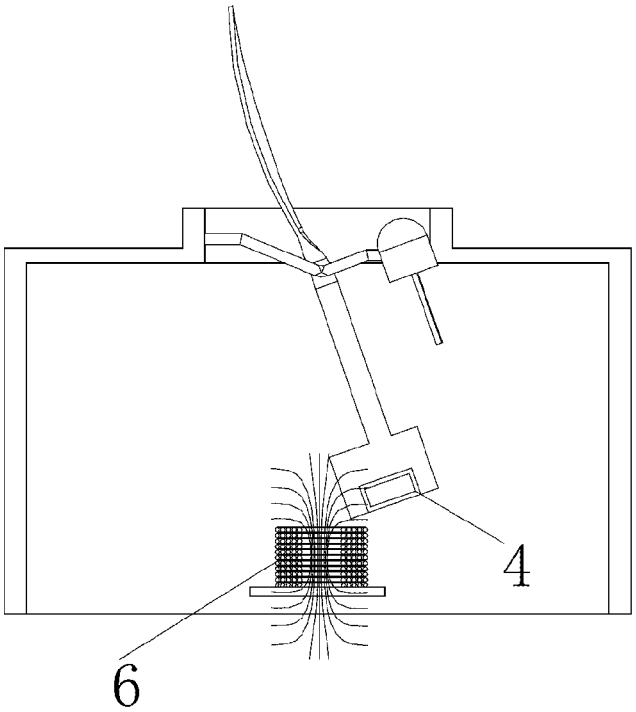
FIG. 17 shows a relative position between the ferromagnet and the magnetic induction lines when the flame sheet being a pendulum member of the electronic lighting device of the existing prior art swings.

In the existing prior art, the drive mechanism is provided at one end of a pendulum member. Therefore, when the flame sheet (pendulum member) swings, the ferromagnet cannot be always positioned within a strong magnetic field of the electromagnetic coil and thus cannot satisfactorily utilize the magnetic force generated by electrical current, as illustrated in FIGS. 16-17. On the contrary, when the flame sheet (pendulum member) swings, the ferromagnet is always positioned within the strong magnetic field of the electromagnetic coil. Therefore, the magnetic force can be much better utilized and thus a weaker current should be sufficient to drive the flame sheet 1 to swing reciprocally, as illustrated in FIGS. 14-15.

What is claimed is:

1. An electronic lighting device simulating real fire comprises a flame sheet (1), a supporting frame (2), a light emitting element (3) and a drive mechanism; the flame sheet (1) comprises a flame section (1.1), a balance section (1.2) and a supporting point (1.3); the supporting point (1.3) is positioned between the flame section (1.1) and the balance section (1.2); wherein the drive mechanism is positioned corresponding to a middle part of the whole vertical length of the flame sheet (1); the drive mechanism exerts driving force to the middle part of the flame sheet (1); wherein the drive mechanism comprises an electromagnetic coil (6) and a permanent magnet/magnetic medium (4); the permanent magnet/magnetic medium (4) is mounted on the middle part of the whole vertical length of flame sheet (1): the electromagnetic coil (6) is also positioned corresponding to the middle part of the whole vertical length of the flame sheet (1) to exert the driving force to the permanent magnet/magnetic medium (4) on the flame sheet (1).

2. The electronic lighting device simulating real fire as in claim 1, wherein the electromagnetic coil (6) and a circuit board (7) are provided on the supporting frame (2).

3. The electronic lighting device simulating real tire as in claim 2, wherein a supporting rod (5) is provided on the supporting frame (2); a small hole is provided on the flame sheet (1) as the supporting point (1.3): part of the supporting rod (5) is bended to form a V shaped structure; the flame sheet (1) is supported on the V shaped structure of the supporting rod (5) via the small hole.

4. The electronic lighting device simulating real tire as in claim 2, wherein a supporting rod (5) is provided, on the supporting frame (2); the supporting rod (5) has a pin shape; the flame sheet (1) is provided with a cap as the supporting point (1.3); the cap has a conical cavity; the supporting point (1.3) with the conical cavity sleeves the supporting rod (5) to support the flame sheet (1).

5. The electronic lighting device simulating real fire as in claim 3 or 4, wherein the permanent magnet/magnetic medium (4) is positioned near to but above the supporting point (1.3) or near to but below the supporting point (1.3).

6. The electronic lighting device simulating real tire as in claim 5, wherein the light emitting element (3) is mourned on the circuit board (7) or on the supporting frame (2).

7. The electronic lighting device simulating real fire as in claim 6, wherein the electronic lighting device simulating real fire also comprises an outer shell (8); an upper end of the outer shell (8) is provided with a through hole for the flame sheet (1) to swing; the outer shell (8) sleeves the supporting frame (2) from outside; only an upper part of the flame sheet (1) passes through the through hole of the outer shell (8).

* * * * *